US009679517B2

(12) United States Patent
Gu et al.

(10) Patent No.: US 9,679,517 B2
(45) Date of Patent: Jun. 13, 2017

(54) PIXEL CIRCUIT AND ORGANIC LIGHT EMITTING DISPLAY INCLUDING THE SAME

(71) Applicant: Samsung Display Co., Ltd., Yongin (KR)

(72) Inventors: Bon-Seog Gu, Yongin (KR); Hae-Kwan Seo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 41 days.

(21) Appl. No.: 14/703,960

(22) Filed: May 5, 2015

(65) Prior Publication Data

US 2016/0012779 A1 Jan. 14, 2016

(30) Foreign Application Priority Data

Jul. 14, 2014 (KR) ..... 10-2014-0088529

(51) Int. Cl.
*G09G 3/32* (2016.01)
*G09G 3/3233* (2016.01)

(52) U.S. Cl.
CPC ... *G09G 3/3233* (2013.01); *G09G 2300/0814* (2013.01); *G09G 2300/0852* (2013.01); *G09G 2300/0861* (2013.01); *G09G 2300/0876* (2013.01); *G09G 2310/0262* (2013.01); *G09G 2310/08* (2013.01); *G09G 2380/00* (2013.01)

(58) Field of Classification Search
CPC ..... G09G 3/3233; G09G 2300/0814; G09G 2300/0852; G09G 2300/0861; G09G 2310/0262; G09G 2310/08; G09G 2380/00
See application file for complete search history.

(56) References Cited

U.S. PATENT DOCUMENTS

2004/0251465 A1* 12/2004 Yamazaki ..... G09G 3/2014 257/79
2006/0202919 A1* 9/2006 Aoki ..... G09G 3/325 345/76
2008/0197784 A1* 8/2008 Benzarti ..... G09G 3/3233 315/169.3

(Continued)

FOREIGN PATENT DOCUMENTS

KR 10-2007-0105082 10/2007
KR 10-2012-0048294 5/2012

(Continued)

*Primary Examiner* — Sahlu Okebato

(74) *Attorney, Agent, or Firm* — H.C. Park & Associates, PLC

(57) ABSTRACT

A pixel circuit includes a first organic light emitting diode (OLED), a second OLED, a storage unit coupled to a data line, the storage unit including a first capacitor configured to store at least one of a first data signal and a second data signal received via the data line, a first driver including a second capacitor configured to store the first data signal received via the storage unit, and a first transistor configured to control an amount of a current supplied to the first OLED in response to a voltage stored in the second capacitor, and a second driver including a third capacitor configured to store the second data signal received via the storage unit, and a second transistor configured to control an amount of a current supplied to the second OLED in response to a voltage stored in the third capacitor.

20 Claims, 3 Drawing Sheets

(56) References Cited

U.S. PATENT DOCUMENTS

| | | | | |
|---|---|---|---|---|
| 2012/0113077 | A1 | 5/2012 | Kang | |
| 2013/0249883 | A1 | 9/2013 | Hwang | |
| 2014/0176402 | A1* | 6/2014 | Lee | G09G 3/32 345/77 |
| 2014/0198085 | A1 | 7/2014 | Park et al. | |

FOREIGN PATENT DOCUMENTS

| | | |
|---|---|---|
| KR | 10-2013-0107677 | 10/2013 |
| KR | 10-2014-0093157 | 7/2014 |

* cited by examiner

PIXEL CIRCUIT AND ORGANIC LIGHT EMITTING DISPLAY INCLUDING THE SAME

CROSS-REFERENCE TO RELATED APPLICATION

This application claims priority from and the benefit of Korean Patent Application No. 10-2014-0088529, filed on Jul. 14, 2014, which is hereby incorporated by reference for all purposes as if fully set forth herein.

BACKGROUND

Field

Exemplary embodiments relate to a pixel and an organic light emitting display using the same.

Discussion

With development of information technology, the importance of display devices as an interface between information and users is unquestionable. Use of flat panel displays (FPDs), such as liquid crystal displays, organic light emitting diode displays, plasma display panels, etc., are one of the many forms of display devices being utilized. Organic light emitting displays, among FPDs, display images using organic light emitting diodes (OLED) that generate light by electron-hole recombination. Organic light emitting displays include relatively fast response times and relatively low power consumption.

Organic light emitting displays may display an image on both sides of the panel by arranging the OLEDs on the upper side and the lower side of the display panel. When the OLED on the upper side of the panel and the OLED on the lower side of the panel are coupled to two different pixel circuits, the manufacturing cost may increase and the layout may be complicated. As such, a method of driving the first OLED configured to supply light towards the upper side of the panel and the second OLED configured to supply light towards the lower side of the panel as one pixel circuit has presented many challenges. It is noted, however, that the light emitting time may reduce when the first OLED and the second OLED are driven as one pixel circuit because, during a period when a voltage of the data signal is supplied to the pixel circuit, both the first OLED and the second OLED are turned off. Accordingly, brightness of the panel may be reduced.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a pixel and an organic light emitting display with improved light emitting time.

Additional aspects will be set forth in the detailed description which follows, and, in part, will be apparent from the disclosure, or may be learned by practice of the inventive concept.

An exemplary embodiment discloses a pixel circuit including a first organic light emitting diode, a second organic light emitting diode, a storage unit coupled to a data line, the storage unit including a first capacitor configured to store at least one of a first data signal and a second data signal received via the data line, a first driver including a second capacitor configured to store the first data signal received via the storage unit and a first transistor configured to control an amount of current supplied to the first organic light emitting diode in response to a voltage stored in the second capacitor, and a second driver including a third capacitor configured to store the second data signal received via the storage unit and a second transistor configured to control an amount of a current supplied to the second organic light emitting diode in response to a voltage stored in the third capacitor.

An exemplary embodiment also discloses an organic light emitting display includes a pixel comprising a pixel circuit, the pixel circuit being coupled to a scan line and a data line, a first organic light emitting diode and a second organic light emitting diode, the first and second organic light emitting diodes being configured to emit light according to a current supplied from the pixel circuit, a scan driver configured to supply scan signals to the scan line, and a data driver configured to supply at least one of a first data signal and a second data signal to a data line in synchronization with one or more of the scan signals, wherein the pixel circuit is configured to store voltage corresponding to at least one of the first data signal and the second data signal, and wherein the scan driver and the data driver are configured to cause, at least in part, the first organic light emitting diode and the second organic light emitting diode to emit light during a voltage storage period of the pixel circuit.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
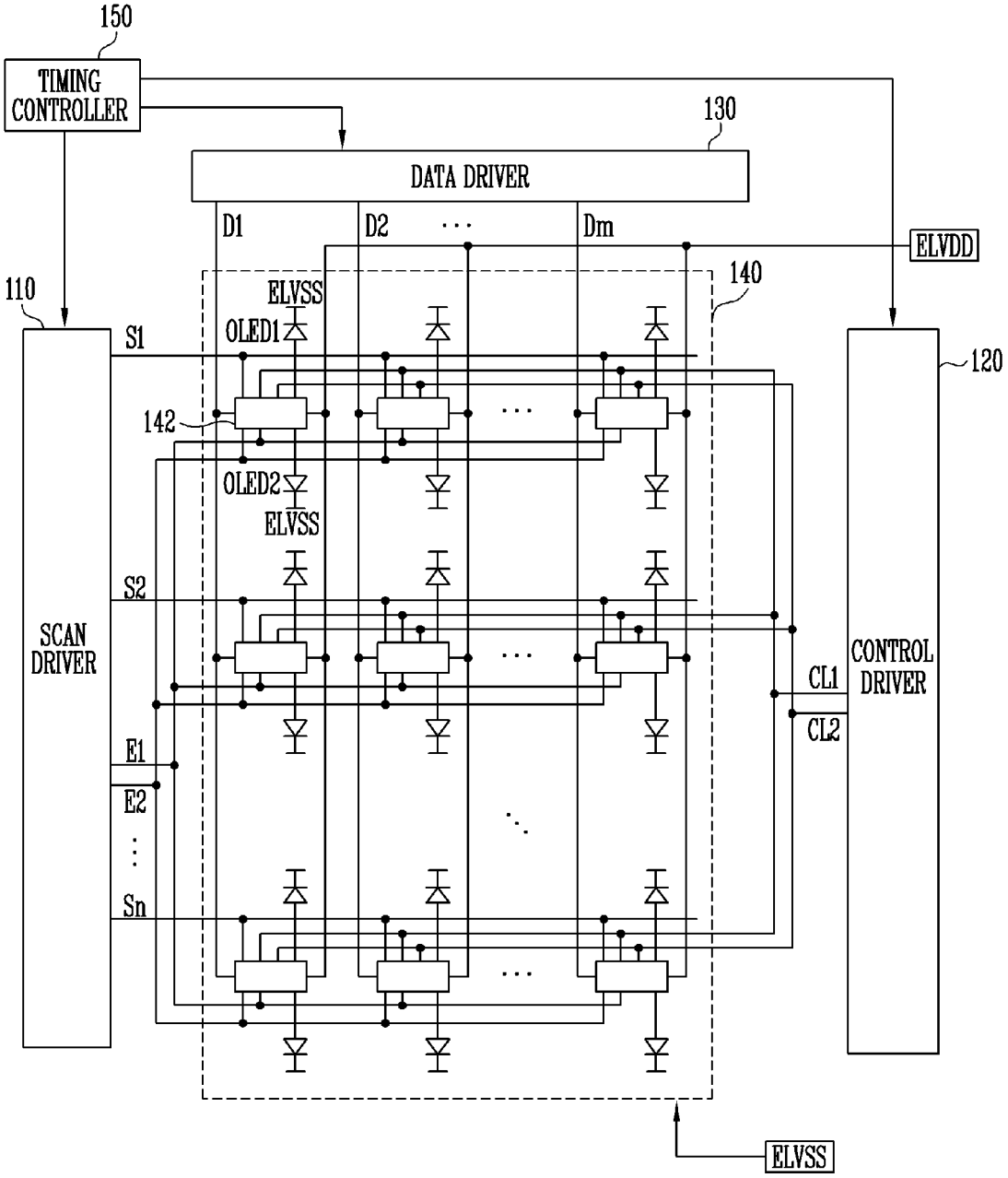
FIG. 1 illustrates an organic light emitting display, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 illustrates an organic light emitting display, according to exemplary embodiments.

Referring to FIG. 1, the organic light emitting display may include a pixel unit 140 including pixel circuits 142 located at regions divided by scan lines S1 to Sn and data lines D1 to Dm, a first organic light emitting diode OLED1 and a second organic light emitting diode OLED2 coupled to the pixel circuits 142, a scan driver 110 configured to drive the scan lines S1 to Sn, a first light emitting control line E1, and a second light emitting controlling line E2, a control driver 120 configured to drive a first control line CL1 and a second control line CL2, a data driver 130 configured to drive the data lines D1 to Dm, and a timing controller 150 configured to control the scan driver 110, the control driver 120, and the data driver 130.

The scan driver 110 may be configured to supply scan signals to the scan lines S1 to Sn. For example, the scan driver 110 may supply scan signals to the scan lines S1 to Sn sequentially during a first period T1 and a third period T3 of a frame, as will be described in more detail in association with FIG. 3. Scan signals may be set to a voltage configured to turn on transistors included in the pixel circuit 142.

The scan driver 110 may be configured to supply a first light emitting control signal to a first light emitting control line E1 and a second light emitting control signal to a second light emitting control line E2. The first and second light emitting control lines E1 and E2 are coupled to the pixel circuit 142. For example, the scan driver 110 may supply a first light emitting control signal to a first light emitting control line E1 during a second period T2 of a frame, and may supply a second light emitting control signal to a second light emitting control line E2 during a fourth period T4 of a frame. The first and second light emitting control signals may be set to a voltage configured to turn off the transistors included in the pixel circuit 142.

The control driver 120 may be configured to supply a first control signal to a first control line CL1 and supply a second control signal to a second control line CL2. For example, the control driver 120 may supply a first control signal to a first control line CL1 during a second period T2 of a frame and supply a second control signal to a second control line CL2 during a fourth period T4 of the frame. The first and second control signals may be set to a voltage configured to turn on the transistors included in the pixel circuit 142.

The data driver 130 may be configured to supply data signals to data lines D1 to Dm so that the data signals are synchronized with scan signals supplied to the scan lines S1 to Sn. The data driver 130 may be configured to supply a first data signal DS1 configured to control brightness of the first organic light emitting diode OLED1 and a second data signal DS2 configured to control brightness of the second organic light emitting diode OLED2. For example, the data driver 130 may supply the first data signal DS1 to the data lines D1 to Dm during the first period T1 of a frame and supply the second data signal DS2 to the data lines D1 to Dm during a third period T3 of the frame.

The pixel unit 140 may include the pixel circuits 142 located at a region divided by the scan lines S1 to Sn and the data lines D1 to Dm. Each of the pixel circuits 142 may be coupled to first organic light emitting diodes OLED1 configured to supply light in a first direction from a panel and coupled to second organic light emitting diodes OLED2 configured to supply light in a second direction from the panel. The first direction may be a direction towards an upper side (or front side) of the panel, and the second direction may be a direction towards a lower side (or rear side) of the panel. That is, the organic light emitting display may display an image from both sides of the panel (double-sided panel), and one pixel circuit 142 may drive the first organic light emitting diode OLED1 and the second organic light emitting diode OLED2, and, thereby, supply light in different directions.

According to exemplary embodiments, the pixel circuit 142 may store a voltage of the first data signal DS1 corresponding to the first organic light emitting diode OLED1 during the first period T1 of a frame and store a voltage of the second data signal DS2 corresponding to the second organic light emitting diode OLED2 during the third period T3. Also, the first and second organic light emitting diodes OLED1 and OLED2 may be set to a light emitting state in which light is emitted during the first and third periods T1 and T3 when the pixel circuit 142 is charged (or otherwise initialized). The light emitting state may be referred to as a state during which brightness of the organic light emitting diodes OLED1 and OLED2 are determined in corresponding to the data signal.

The first organic light emitting diode OLED1 and the second organic light emitting diode OLED2 coupled to the same pixel circuit 142 may be disposed towards the upper side and the lower side of the panel, as well as may be adjacent to each other. The first and second organic light emitting diodes OLED1 and OLED2 may generate light having the same color. The first organic light emitting diode OLED1 and the second organic light emitting diode OLED2 coupled to the same pixel circuit 142 may also be disposed towards the left side and the right side of the panel, adjacent to each other, and generate light having different colors.

In FIG. 1, although the control lines CL1 and CL2 are illustrated as being driven by the control driver 120 for descriptive convenience, exemplary embodiments are not limited thereto. For example, at least one of the control lines CL1 and CL2 may be driven by the scan driver 110.

In exemplary embodiments, the scan driver 110, the control driver 120, the data driver 130, and the timing controller 150, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the scan driver 110, the control driver 120, the data driver 130, and the timing controller 150, and/or one or more components thereof may include or otherwise be associated with one or more memories (not shown) including code (e.g., instructions) configured to cause the scan driver 110, the control driver 120, the data driver 130, and the timing controller 150, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CDRW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 2:
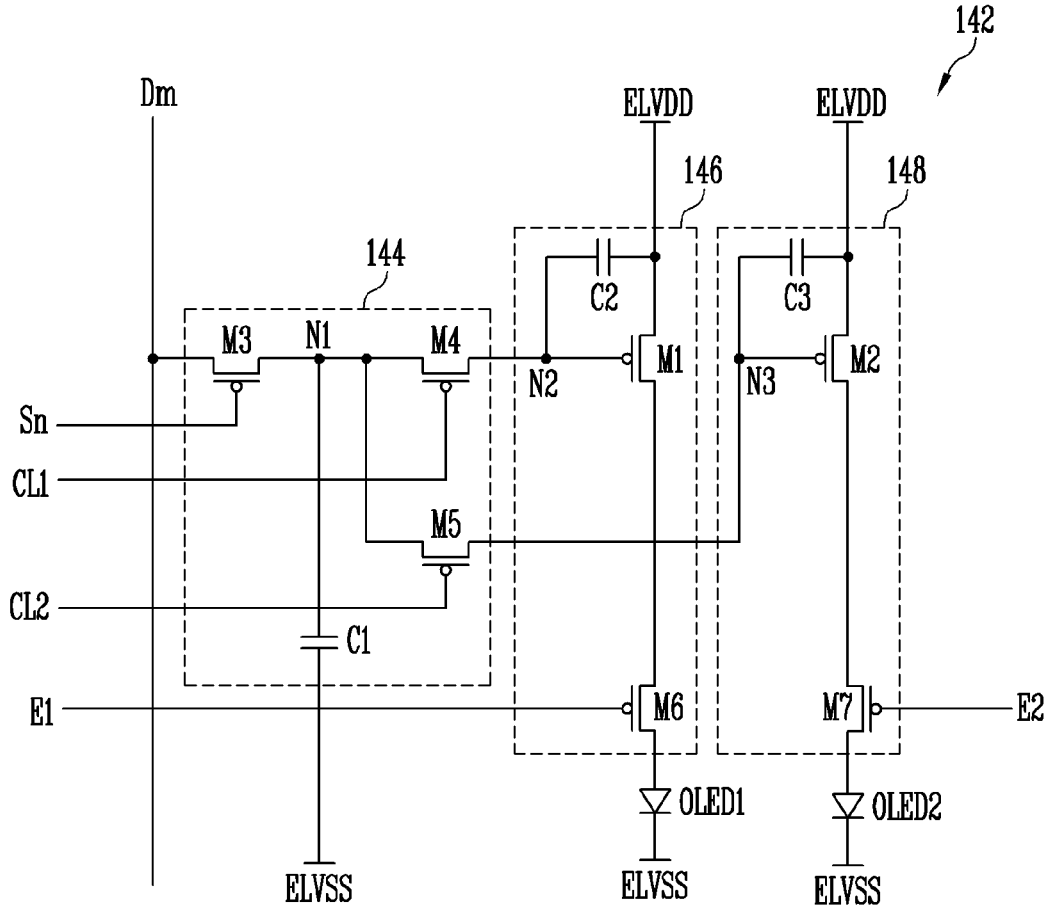
FIG. 2 illustrates a pixel circuit of the organic light emitting display of FIG. 1, according to exemplary embodiments.

FIG. 2 illustrates a pixel circuit of the organic light emitting display of FIG. 1, according to exemplary embodiments. For descriptive and illustrative purposes, FIG. 2 illustrates a pixel circuit coupled to the m-th data line Dm and the n-th scan line Sn of the organic light emitting display of FIG. 1. It is noted that other pixel circuits of the organic light emitting display of FIG. 1 may be similarly configured.

Referring to FIG. 2, the pixel circuit 142 may include a storage unit 144, a first driver 146, and a second driver 148. The storage unit 144 may store a first data signal DS1 or a second data signal DS2 from the data line Dm and transfer a stored data signal to the first driver 146 and the second driver 148. To this end, the storage unit 144 may include a third transistor M3, a fourth transistor M4, a fifth transistor M5, and a first capacitor C1.

The third transistor M3 may be coupled between the data line Dm and a first node N1. A gate electrode of the third transistor M3 may be coupled to the scan line Sn. The third transistor M3 may be turned on and electrically couple the data line Dm and the first node N1 when the scan signal is supplied to the scan line Sn.

The fourth transistor M4 may be coupled between the first node N1 and a second node N2 associated with the first driver 146. A gate electrode of the fourth transistor M4 may be coupled to the first control line CL1. The fourth transistor M4 may be turned on and electrically couple the first node N1 and the second node N2 when the first control signal is supplied to the first control line CL1.

The fifth transistor M5 may be coupled between the first node N1 and a third node N3 associated with the second driver 148. A gate electrode of the fifth transistor M5 may be coupled to the second control line CL2. The fifth transistor M5 may be turned on and electrically couple the first node N1 and the third node N3 when the second control signal is supplied to the second control line CL2.

The first capacitor C1 may be coupled between the first node N1 and a constant voltage source. The first capacitor C1 may store the voltage of the first data signal DS1 or the second data signal DS2 applied to the first node N1. The constant voltage source may have a constant voltage level, e.g., a second power source ELVSS.

The first driver 146 may control an amount of a current supplied to the first organic light emitting diode OLED1 corresponding to the first data signal DS1 supplied from the storage unit 144. The first driver 146 may include a first transistor M1, a sixth transistor M6, and a second capacitor C2.

The first transistor M1 may be coupled between the first power source ELVDD and an anode electrode of the first organic light emitting diode OLED1. A gate electrode of the first transistor M1 may be coupled to the second node N2. The first transistor M1 may control an amount of a current flowing from the first power source ELVDD to the second power source ELVSS through the first organic light emitting diode OLED 1 corresponding to a voltage of the second node N2. The first power source ELVDD may have a voltage level higher than the voltage level of the second power source ELVSS.

The sixth transistor M6 may be coupled between the first transistor M1 and the anode electrode of the first organic light emitting diode OLED1. A gate electrode of the sixth transistor M6 may be coupled to the first light emitting control line E1. The sixth transistor M6 may be turned off when the first light emitting control signal is supplied to the first light emitting control line E1 and may be turned on in all other instances.

The second capacitor C2 may be coupled between the first power source ELVDD and the second node N2. The second capacitor C2 may store the voltage of the first data signal DS1 supplied from the storage unit 144. The second capacitor C2 may have a capacitance lower than the capacitance of the first capacitor C1.

The second driver 148 may control an amount of current supplied to the second organic light emitting diode OLED 2 corresponding to the second data signal DS2 supplied from the storage unit 144. The second driver 148 may include a second transistor M2, a seventh transistor M7, and a third capacitor C3.

The second transistor M2 may be coupled between the first power source ELVDD and the anode electrode of the second organic light emitting diode OLED2. The gate electrode of the second transistor M2 may be coupled to the third node N3. The second transistor M2 may control an amount of current supplied from the first power source ELVDD to the second power source ELVSS through the second organic light emitting diode OLED2 corresponding to a voltage of the third node N3.

The seventh transistor M7 may be coupled between the second transistor M2 and the anode electrode of the second organic light emitting diode OLED2. A gate electrode of the seventh transistor M7 may be coupled to the second light emitting control line E2. The seventh transistor M7 may be turned off when the second light emitting control signal is supplied to the second light emitting control line E2 and turned on in all other instances.

The third capacitor C3 may be coupled between the first power source ELVDD and the third node N3. The third capacitor C3 may store the voltage of the second data signal DS2 supplied from the storage unit 144. The third capacitor C3 may have a capacitance lower than the capacitance of the first capacitor C1.

Figure 3:
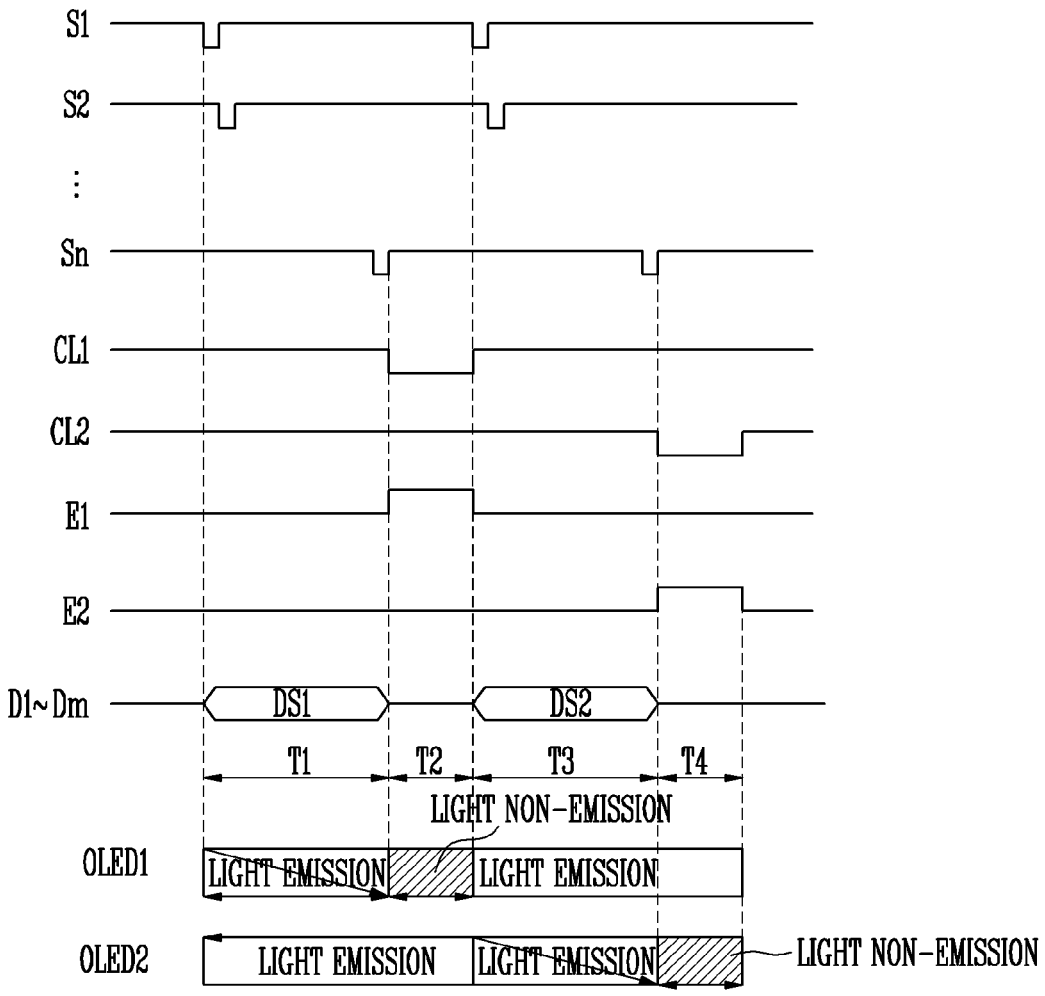
FIG. 3 is a waveform diagram illustrating a method of driving a pixel of the organic light emitting display of FIG. 1, according to exemplary embodiments.

FIG. 3 is a waveform diagram illustrating a method of driving a pixel of the organic light emitting display of FIG. 1, according to exemplary embodiments. For descriptive purposes, FIG. 3 will be explained in connection with the pixel shown in FIG. 2.

Referring to FIG. 3, a frame may include the first period T1, the second period T2, the third period T3, and the fourth period T4. The scan driver 110 may sequentially supply scan signals to the scan lines S1 through Sn during the first period T1. When the scan signals are supplied to the scan lines S1 to Sn sequentially, the pixel circuit 142 may be selected on a horizontal line basis. The data driver 130 may supply first data signals to the data lines D1 to Dm so that the data driver 130 is synchronized with the scan signals applied to the scan lines S1 to Sn during the first period T1. The first data signals DS1 supplied to the data lines D1 to Dm may be supplied to the selected pixel circuits 142 selected by the scan signals. For example, when the scan signal is supplied to the n-th scan line Sn, the third transistor M3 may be turned on. When the third transistor M3 is turned on, the first data signal DS1 may be supplied to the first node N1 from the data line Dm. The first capacitor C1 may store a voltage corresponding to the first data signal DS1.

The first organic light emitting diode OLED1 included in the pixel circuit 142 may supply light in the first direction of the panel corresponding to the first data signal DS1, which was supplied during the first period T1 of a previous frame, and the second organic light emitting diode OLED2 included in the pixel circuit 142 may supply light in the second direction of the panel corresponding to the second data signal DS2, which was supplied during the first period T1 of the previous frame. The first organic light emitting diodes OLED1 and the second organic light emitting diodes OLED2 may be set to the light emitting state during the first period T1 when the voltage corresponding to the first data signal DS1 is stored in the pixel circuit 142.

The control driver 120 may supply the first control signal to the first control line CL1 during the second period T2. The scan driver 110 may supply the first light emitting control signal to the first light emitting control line E1 during the second period T2. When the first light emitting control signal is supplied to the first light emitting control line E1, the sixth transistor M6 included in each of the pixel circuits 142 may be turned off. When the sixth transistor M6 is turned off, the first organic light emitting diodes OLED 1 may be set to a non-light emitting state. The non-light emitting state may refer to a state in which the first organic light emitting diode OLED1 is turned off irrespective of the data signal.

When the first control signal is supplied to the first control line CL1, the fourth transistor M4 included in each of the pixel circuits 142 may be turned on. When the fourth transistor M4 is turned on, the first node N1 and the second node N2 may be electrically coupled. When the first node N1 and the second node N2 are electrically coupled, a voltage of the second node N2 may change due to charge sharing between the first capacitor C1 and the second capacitor C2. When the first capacitor C1 has a capacitance higher than the capacitance of the second capacitor C2, the voltage of the second node N2 may approximately change to the voltage of the first data signal DS1. Therefore, the second capacitor C2 may store a voltage corresponding to the first data signal DS1 during the second period T2.

The control driver 120 may stop supplying the first control signal to the first control line CL1 during the third period T3. The scan driver 110 may stop supplying the first light emitting control signal to the first light emitting control line E1 during the third period T3. The fourth transistor M4 included in each of the pixel circuits 142 may be turned off and the sixth transistor M6 may be turned on. When the sixth transistor M6 is turned on, the first transistor M1 and the first organic light emitting diode OLED1 may be electrically coupled, and the first organic light emitting diode OLED1 may be set to the light emitting state.

Scan signals are sequentially supplied to the scan lines S1 to Sn during the third period T3, and the second data signal DS2 may be sequentially supplied to the data lines D1 to Dm. Each of the pixel circuits 142 may store a voltage corresponding to the second data signal DS2 during the third period T3. The first organic light emitting diodes OLED1 and the second organic light emitting diodes OLED2 included in the pixel unit 140 may be set to the light emitting state during the third period T3.

The control driver 120 may supply the second control signal to the second control line CL2 during a fourth period T4. The scan driver 110 may supply the second light emitting control signal to the second light emitting control line E2 during the fourth period T4. When the second light emitting control signal is supplied to the second light emitting control line E2, the seventh transistor M7 included in each of the pixel circuits 142 may be turned off. When the seventh transistor M7 is turned off, the second organic light emitting diodes OLED2 may be set to the non-light emitting state.

When the second control signal is supplied to the second control line CL2, the fifth transistor M5 included in each of the pixel circuit 142 may be turned on. When the fifth transistor M5 is turned on, the first node N1 and the third node N3 may be electrically coupled. When the first node N1 and the third node N3 are electrically coupled, a voltage of the third node N3 may change due to charge sharing between the first capacitor C1 and the third capacitor C3. When the first capacitor C1 has a capacitance higher than the capacitance of the third capacitor C3, the voltage of the third node N3 may approximately change to the voltage of the second data signal DS2. The third capacitor C3 may store a voltage corresponding to the second data signal DS2 during the fourth period T4.

The control driver 120 may stop supplying the second control signal, and the scan driver 110 may stop supplying the second light emitting control signal after the fourth period T4. The fifth transistor M5 included in each of the pixel circuits 142 may be turned off, and the seventh transistor M7 may be turned on. When the seventh transistor M7 is turned on, the second transistor M2 and the second organic light emitting diode OLED2 may be electrically coupled. The second organic light emitting diode OLED2 may be set to the light emitting state.

As described above, the first organic light emitting diode OLED1 and the second organic light emitting diode OLED2 may be set to the light emitting state while the first data signal or the second data signal is stored in the pixel circuit 142. That is, the light emitting time may be improved when both sides of the panel display an image, and, accordingly, the displayed image may have improved brightness.

For the convenience of description, the transistors are illustrated as p-channel metal oxide semiconductors (PMOS), but exemplary embodiments are not limited thereto. For instance, exemplary embodiments may include n-channel metal oxide semiconductors (NMOS) or any other suitable switching device configured to operate in association with exemplary embodiments described herein.

The OLED may generate any suitable color (e.g., red, green, blue, white, etc.) light depending on a current. When the OLED generates white light, exemplary embodiments may include at least one color filter to implement a color display As such, the organic light emitting display may include a plurality of pixels that are arranged in a matrix form at intersections (or crossing regions) divided by data lines, scan lines, and/or power lines. The pixels may include OLEDs, two or more transistors including a driving transistor, and one or more capacitors. Organic light emitting displays may display an image on both sides of the panel by arranging the OLEDs on the upper side and the lower side of the display panel. When the OLED on the upper side of the panel and the OLED on the lower side of the panel are coupled to two different pixel circuits, the manufacturing cost may increase and the layout may be complicated. As such, a method of driving a first OLED configured to supply light towards the upper side of the panel and a second OLED configured to supply light towards the lower side of the panel via one pixel circuit has been described. It is noted, however, that the light emitting time may reduce when the first OLED and the second OLED are driven as one pixel circuit because, during a period when a voltage of the data signal is supplied to the pixel circuit, both the first OLED and the second OLED are turned off. As such, brightness of the panel may be reduced.

The pixel and the organic light emitting display according to exemplary embodiments, however, may drive two OLEDs configured to supply light in different directions as one pixel circuit. The two OLEDs may maintain the light emitting state during a period when voltage of a data signal is stored in the pixel circuit, and the brightness of the produced image may be improved.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A pixel circuit, comprising:

a first organic light emitting diode;

a second organic light emitting diode;

a storage unit coupled to a data line, the storage unit comprising a first capacitor configured to store at least one of a first data signal and a second data signal received via the data line;

a first driver comprising:

a second capacitor configured to store the first data signal received via the storage unit; and a first transistor configured to control an amount of current supplied to the first organic light emitting diode in response to a voltage stored in the second capacitor; and a second driver comprising:

a third capacitor configured to store the second data signal received via the storage unit; and a second transistor configured to control an amount of current supplied to the second organic light emitting diode in response to a voltage stored in the third capacitor.

2. The pixel circuit of claim 1, wherein:

the first organic light emitting diode is configured to emit light in a first direction;

the second organic light emitting diode is configured to emit light in a second direction; and the second direction is different from the first direction.

3. The pixel circuit of claim 2, wherein:

the pixel circuit is incorporated into a display panel; and the first direction is towards an upper side of the display panel and the second direction is towards a lower side of the display panel.

4. The pixel circuit of claim 1, wherein:

the storage unit further comprises:

a third transistor coupled between the data line and a first node, the third transistor being configured to be turned on in response to a scan signal being supplied, via a scan line, to a gate electrode of the third transistor;

a fourth transistor coupled between the first node and a gate electrode of the first transistor; and a fifth transistor coupled between the first node and a gate electrode of the second transistor; and the first capacitor is coupled between the first node and a first voltage source.

5. The pixel circuit of claim 4, wherein configuration of the pixel circuit causes, at least in part, turn-on periods of the third transistor, the fourth transistor, and the fifth transistor to not overlap one another.

6. The pixel circuit of claim 4, wherein:

a first electrode of the first transistor is coupled to a first power source, the first transistor being configured to control the amount of current supplied from the first power source to the first organic light emitting diode in response to the voltage stored in the second capacitor;

the second capacitor is coupled between the gate electrode of the first transistor and the first power source; and the first driver further comprises a sixth transistor coupled between a second electrode of the first transistor and the first organic light emitting diode, the sixth transistor being configured to operate opposite an operation of the fourth transistor.

7. The pixel circuit of claim 4, wherein:

a first electrode of the second transistor is coupled to a first power source, the second transistor being configured to control the amount of current supplied from the first power source to the second organic light emitting diode in response to the voltage stored in the third capacitor;

the third capacitor is coupled between the gate electrode of the second transistor and the first power source; and the second driver further comprises a seventh transistor coupled between a second electrode of the second transistor and the second organic light emitting diode, the seventh transistor being configured to operate opposite an operation of the fifth transistor.

8. An organic light emitting display, comprising:

a pixel comprising a pixel circuit, the pixel circuit being coupled to a scan line and a data line;

a first organic light emitting diode and a second organic light emitting diode, the first and second organic light emitting diodes being configured to emit light according to a current supplied from the pixel circuit;

a scan driver configured to supply scan signals to the scan line; and a data driver configured to supply at least one of a first data signal and a second data signal to a data line in synchronization with one or more of the scan signals, wherein the pixel circuit is configured to store voltage corresponding to at least one of the first data signal and the second data signal, and wherein the scan driver and the data driver are configured to cause, at least in part, the first organic light emitting diode and the second organic light emitting diode to emit light during a voltage storage period of the pixel circuit.

9. The organic light emitting display of claim 8, wherein:

the first organic light emitting diode is configured to emit light in a first direction;

the second organic light emitting diode is configured to emit light in a second direction; and the second direction is different from the first direction.

10. The organic light emitting display of claim 9, wherein:

the first direction is towards an upper side of the organic light emitting display;

the second direction is towards a lower side of organic light emitting display.

11. The organic light emitting display of claim 8, further comprising:

a first control line;

a second control line;

a first light emitting control line; and a second light emitting control line, wherein the first control line, the second control line, the first light emitting control line, and the second light emitting control line are coupled, in association with the scan line and the data line, to the pixel circuit.

12. The organic light emitting display of claim 11, wherein:

the data driver is configured to:

supply the first data signal to the pixel circuit during a first period of a frame, the first data signal being associated with the first organic light emitting diode; and supply the second data signal to the pixel circuit during a second period of the frame, the second data signal being associated with the second organic light emitting diode; and the scan driver is configured to supply the scan signals to the scan line during the first and second periods.

13. The organic light emitting display of claim 12, further comprising:

a control driver configured to:

supply a first control signal to the first control line during a third period of the frame, the third period being between the first period and the second period; and supply a second control signal to the second control line during a fourth period of the frame, the fourth period being after the second period, wherein the scan driver is further configured to:

supply a first light emitting control signal to the first light emitting control line during the third period; and supply a second light emitting control signal to the second light emitting control line during the fourth period.

14. The organic light emitting display of claim 13, wherein the pixel circuit comprises:

a storage unit coupled to the data line, the storage unit comprising a first capacitor configured to store at least one of the first data signal and the second data signal;

a first driver comprising:

a second capacitor configured to store the first data signal received via the storage unit; and a first transistor configured to control an amount of current supplied to the first organic light emitting diode in response to a voltage stored in the second capacitor; and a second driver comprising:

a third capacitor configured to store the second data signal received via the storage unit; and a second transistor configured to control an amount of current supplied to the second organic light emitting diode in response to a voltage stored in the third capacitor.

15. The organic light emitting display of claim 14, wherein a capacitance of the first capacitor is greater than a capacitance of the second capacitor.

16. The organic light emitting display of claim 14, wherein a capacitance of the first capacitor is greater than a capacitance of the third capacitor.

17. The organic light emitting display of claim 14, wherein:

the storage unit further comprises:

a third transistor coupled between the data line and a first node, the third transistor being configured to be turned on in response to a scan signal being supplied, via the scan line, to a gate electrode of the third transistor;

a fourth transistor coupled between the first node and a gate electrode of the first transistor, the fourth transistor being configured to be turned on in response to the first control signal being supplied to the pixel circuit; and a fifth transistor coupled between the first node and a gate electrode of the second transistor, the fifth transistor being configured to be turned on in response to the second control signal being supplied to the pixel circuit; and the first capacitor is coupled between the first node and a first voltage source.

18. The organic light emitting display of claim 17, wherein the first voltage source is coupled to cathode electrodes of the first and second organic light emitting diodes.

19. The organic light emitting display of claim 14, wherein:

a first electrode of the first transistor is coupled to a first power source, the first transistor being configured to control the amount of current supplied from the first power source to the first organic light emitting diode in response to the voltage stored in the second capacitor;

the second capacitor is coupled between a gate electrode of the first transistor and the first power source; and the first driver further comprises a sixth transistor coupled between a second electrode of the first transistor and the first organic light emitting diode, the sixth transistor being configured to be turned off only when the first light emitting control signal is received via the pixel circuit.

20. The organic light emitting display of claim 14, wherein:

a first electrode of the second transistor is coupled to a first power source, the second transistor being configured to control the amount of current supplied from the first power source to the second organic light emitting diode in response to the voltage stored in the third capacitor;

the third capacitor is coupled between a gate electrode of the second transistor and the first power source; and the second driver further comprises a seventh transistor coupled between a second electrode of the second transistor and the second organic light emitting diode, the seventh transistor being configured to be turned off only when the second light emitting control signal is received via the pixel circuit.

* * * * *